United States Patent [19]

Kagawa

[11] 4,439,753

[45] Mar. 27, 1984

[54] THICK FILM PRINTED CIRCUIT

[75] Inventor: Yoshii Kagawa, Soma, Japan

[73] Assignee: Alps Electric Co., Ltd., Tokyo, Japan

[21] Appl. No.: 175,956

[22] Filed: Aug. 7, 1980

[30] Foreign Application Priority Data

Aug. 7, 1979 [JP] Japan ..... 54-108812[U]

[51] Int. Cl.[3] ..... H01C 1/14

[52] U.S. Cl. ..... 338/325

[58] Field of Search ..... 338/307-309, 338/320, 322, 324, 325, 328, 333, 334

[56] References Cited

U.S. PATENT DOCUMENTS

| | | | |
|---|---|---|---|
| 2,075,733 | 3/1937 | Lazarus . | |
| 3,876,912 | 4/1975 | Sanders | 137/101 A |
| 3,958,075 | 5/1976 | Kaufman | 174/16 HS |
| 4,172,248 | 10/1979 | Okuya | 338/176 |
| 4,309,687 | 1/1982 | Utner et al. | 338/309 X |

FOREIGN PATENT DOCUMENTS

| | | | |
|---|---|---|---|
| 46-26007 | 7/1971 | Japan | 338/320 |

OTHER PUBLICATIONS

H. C. Briel, et al., *Western Electric Technical Digest*, "Compact Pattern of Parallel Film Resistors with Uniform Power Dissipation Capability", No. 33, p. 19, Jan. 1974.

*Primary Examiner*—C. L. Albritton

*Attorney, Agent, or Firm*—Guy W. Shoup; Gerard F. Dunne

[57] ABSTRACT

A potential dividing circuit comprising a plurality of independent electrode patterns spaced equally between two electrode patterns, and a resistance pattern having uniform width is provided between said two electrode patterns; wherein any one of said plurality of independent patterns is an electrode and another of the remaining independent electrode patterns is adapted to serve as dummy electrodes, whereby exact divided voltage can be obtained.

4 Claims, 3 Drawing Figures

THICK FILM PRINTED CIRCUIT

BACKGROUND OF THE INVENTION

The present invention relates to a thick film printed circuit formed on a ceramic substrate or a printing substrate by printing techniques, and more particularly, relates to a thick film printed circuit for dividing potentials.

Most thick film printed circuits have the advantage that relatively exact resistance values can be obtained, for the resistance patterns and/or electrode patterns are formed by a printing operation which ordinarily results in rather high precision.

However, where at is desired to obtain divided potentials by dividing a certain voltage from a resistance of a predetermined fixed value formed by printing, the output voltages actually obtained often do not meet those theoretically predicted for the circuit.

SUMMARY OF THE INVENTION

It is the primary object of the present invention to provide a thick film printed circuit including a potential dividing circuit by which any desired divided potentials can be obtained accurately.

It is other object of the present invention to provide a thick film printed circuit including a potential dividing circuit which provides non-uniformity for the divided potentials.

It is further other object of the present invention to provide an excellent structure of a potential dividing circuit having high performance which can be constructed by almost the same printing processes as those practiced conventionally.

PREFERRED EMBODIMENT OF THE INVENTION

Figure 1:
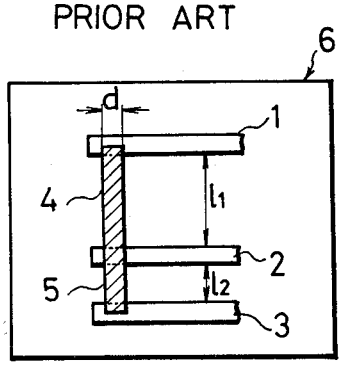
Fig. 1 PRIOR ART
FIG. 1 is a plan view of a thick film printed circuit.

FIG. 1 illustrates the construction of a potential dividing circuit formed by thick film printed circuit typical of the prior art.

Conventionally, in order to take up voltage divided from a resistance pattern in the thick film printed circuit, as shown in FIG. 1, electrode patterns (1) and (3) and an intermediate electrode pattern (2) are printed on a ceramnic substrate, a printing substrate or the like, to form a desired electrode pattern. Then, on the electrode pattern, an integrated resistance pattern consisted of resistance patterns (4) and (5) connected to one another is printed to form a potential dividing circuit, wherein the desired divided potential can be taken out from the intermediate electrode pattern (2).

However, in such a pattern construction, particularly where the length of the resistance pattern (4) is not equal to the length of resistance pattern (5), for example, where the length of the resistance pattern (4) is longer than that of the resistance pattern (5), i.e. $l_1 > l_2$, the ratio of the divided voltage in actual practice does not always agree with the voltage ratio designed at the planning stage.

Figure 2:
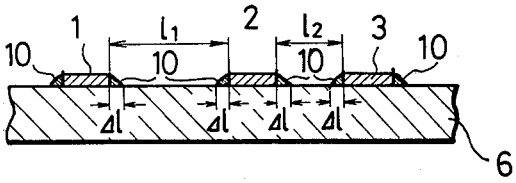
Fig. 2 PRIOR ART
FIG. 2 is a sectional view of a thick film printed circuit for illustrating protruded edge generally formed at the edge of the pattern of the thick film circuit.

The aforementioned disadvantage results when the electrode patterns (1), (3) and the intermediate electrode pattern (2) are printed on the substrate (6). As shown in FIG. 2, a sloping edge portion (10) is formed along the lengths of the electrode patterns, and these sloping edge portions have a width of $\Delta l$. The lengths of the resistance patterns (4) and (5) thus become shorter by $2\Delta l$ than those lengths would be without the sloping edge portions being formed. When the resistance patterns are of unequal length, the ratio of these lengths designed at the planning stage will thus not likely be maintained. This, of course, alters the output potential from its desired value.

Figure 3:
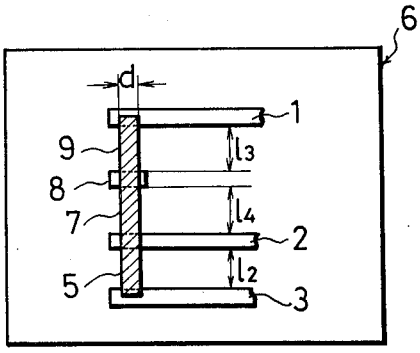
FIG. 3 is a plan view of an embodiment of the thick film printed circuit according to the present invention.

Next, one of the embodiments of the present invention is explained referring to FIG. 3.

The electrode patterns (1), (3) and the intermediate electrode pattern (2) are synchronously printed on the substrate (6) to compose a dividing potential circuit capable of dividing the input potential by one-third. Simultaneously therewhith, another intermediate electrode pattern (8) is printed. The desired divided potential is taken out from the intermediate electrode pattern (2), and the other intermediate electrode pattern (8) remains a dummy electrode.

In providing a dummy electrode by the intermediate electrode pattern (8) between the electrode pattern (1) and the intermdiate electrode pattern (2), the sloping edge portions (10) formed at each of the electrode patterns has an equal effect on each of the resistance patterns, respectively. In other words, it is as follows:

Consider the length of a resistance pattern (9) formed between the electrode patterns (1) and (8) to the $l_1$, the sum of the widths of the sloping edge portions (10) at both ends of the resistance pattern (9) to be $2\Delta l$, the length of the resistance pattern (7) formed between the electrode patterns (8) and (2) to be $l_4$, the length of its sloping edge portions (10) to be $2\Delta l$, the length of the resistance pattern (5) formed between the electrode patterns (2) and (3) to be $l_2$ and that of its sloping edge portions (10) to be $2\Delta l$, the ratio of $l_3+l_4:l_2=2:1$ since the input potential is to be divided by one-third. Further, in the case of the width, depth and specific electric resistance of each pattern being equal, the resistance values of the resistance patterns (5), (7) and (9) are in proportion to their length. Accordingly, if it is assumed that the value of input voltage is E, and that of output voltage is V, then V can be represented by the following expression;

$$V = \frac{l_2 - 2\Delta l}{l_3 - 2\Delta l + l_4 - 2\Delta l + l_2 - 2\Delta l} E$$

$$= \frac{l_2 - 2\Delta l}{l_3 + l_4 + l_2 - 6\Delta l} E$$

$$= \tfrac{1}{3} E$$

As can be clearly understood from the above represented expression, no effect is given by the sloping edge portions (10), which results in reducing adverse effects of the sloping edge portions.

In the embodiment described above, the potential is divided by one-third. The potential may also be divided by one-fourth of the input potential by providing two intermediate electrode patterns equally spaced between the electrode pattern (1) and the intermediate electrode pattern (2) to serve as dummy electrodes; and in the case desired to divide potential to two-fifths of the input potential, two intermediate electrode patterns serving as two dummy electrodes are disposed between the electrode pattern (1) and the intermediate electrode pattern (2), and in addition, an intermediate electrode pattern serving as a dummy electrode may be disposed between the intermediate electrode pattern (2) and the electrode pattern (3).

As described above in detail, if it is desired to divide a certain voltage by the ratio of m:n by printed resistance patterns, it is achieved as follows; that is, (n+1) of the electrode patterns are provided on the substrate, and voltage is applied between the first electrode pattern and the (n+1)th electrode pattern, and then voltage is taken out from the (n+1−m)th electrode pattern.

What is claimed is:

1. A thick film printed circuit including a potential dividing circuit formed from a plurality of printed resistance patterns for dividing voltage applied to the potential dividing circuit in the ratio of m:n, said potential dividing circuit comprising n+1 electrode patterns equally spaced from one another and a resistance pattern having a constant width printed transversely of each of said electrode patterns; said potential dividing circuit including means for applying a predetermined voltage between the first of said electrode patterns and the (n+1)th electrode pattern, and means including the (n+1−m)th electrode pattern in said plurality of electrode patterns for receiving a potential divided from said predetermined potential.

2. A printed circuit as set forth in claim 1, one of said electrode patterns including a dummy electrode connected electrically to said resistance pattern and to no other circuit component of the printed circuit.

3. A method for dividing voltage applied to a potential dividing circuit of a thick film printed circuit in the ratio of m:n, said potential dividing circuit comprising n+1 electrode patterns equally spaced from one another and a resistance pattern having a constant width printed transversely of each of said electrode patterns; the steps including:

applying a predetermined voltage between the first of said electrode patterns and the (n+1)th electrode pattern, and receiving a potential divided from said predetermined potential by using the (n+1−m)th electrode pattern in said plurality of electrode patterns.

4. A method as set forth in claim 3, one of said electrode patterns including a dummy electrode connected electrically to said resistance pattern and to no other circuit component of the printed circuit.

* * * * *